US010767848B2

(12) United States Patent
Kline et al.

(10) Patent No.: US 10,767,848 B2
(45) Date of Patent: Sep. 8, 2020

(54) EXTRUDED HEAT SINK

(71) Applicants: Bret E. Kline, Columbus, OH (US); Randy Goodman, Petoskey, MI (US)

(72) Inventors: Bret E. Kline, Columbus, OH (US); Randy Goodman, Petoskey, MI (US)

( * ) Notice: Subject to any disclaimer, the term of this patent is extended or adjusted under 35 U.S.C. 154(b) by 0 days.

(21) Appl. No.: 16/152,773

(22) Filed: Oct. 5, 2018

(65) Prior Publication Data

US 2020/0109848 A1 Apr. 9, 2020

(51) Int. Cl.

| | |
|---|---|
| ***F21V 29/75*** | (2015.01) |
| ***F21K 9/27*** | (2016.01) |
| ***F21V 29/83*** | (2015.01) |
| ***F21V 29/85*** | (2015.01) |
| ***F21V 29/507*** | (2015.01) |
| ***F21V 29/76*** | (2015.01) |
| ***F21K 9/90*** | (2016.01) |
| ***F21Y 115/10*** | (2016.01) |
| ***F21Y 103/10*** | (2016.01) |

(52) U.S. Cl.

CPC ..... *F21V 29/75* (2015.01); *F21K 9/27* (2016.08); *F21K 9/90* (2013.01); *F21V 29/507* (2015.01); *F21V 29/76* (2015.01); *F21V 29/83* (2015.01); *F21V 29/85* (2015.01); *F21Y 2103/10* (2016.08); *F21Y 2115/10* (2016.08)

(58) Field of Classification Search

CPC ..... F21V 29/75; F21V 29/76; F21V 29/507; F21V 29/83; F21V 29/85; F21K 9/27; F21Y 2103/10; F21Y 2115/10

See application file for complete search history.

(56) References Cited

U.S. PATENT DOCUMENTS

2010/0214744 A1* 8/2010 Liang ..... F21S 8/086 361/714
2010/0254148 A1* 10/2010 Huang ..... F21V 15/013 362/373
2016/0329641 A1* 11/2016 Lee ..... H01Q 15/14

* cited by examiner

*Primary Examiner* — Joseph L Williams
*Assistant Examiner* — Jose M Diaz
(74) *Attorney, Agent, or Firm* — Steven A. Hill

(57) ABSTRACT

An article of manufacture comprising a heat sink to be attached a heat source, being coupled thermally and directly for conductive flow of heat from the heat source to the heat sink. The heat sink is formed via extrusion of material of suitable density and mass to absorb heat from the heat source based on design requirements. The extruded heat sink is configured with specially oriented extruded fins and machined cross cuts to increase surface area available to air flow, and arranged for efficient passage of air around the extruded heat sink, thus effecting efficient convection of heat into the air ambient. Cross cuts and fin are specifically arranged to enhance the "stack effect," or "chimney effect," associated with air flow. An objective is to maximize air flow across available surface area, and thus to enhance removal of heat into the air ambient.

3 Claims, 11 Drawing Sheets

EXTRUDED HEAT SINK

CROSS-REFERENCE TO RELATED APPLICATIONS

This application claims priority to U.S. Provisional application No. 62/569,080, filed Oct. 6, 2017, the contents of which are incorporated herein by reference.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

FIELD OF THE TECHNOLOGY

The subject technology is in the technical field of heat sinks, particularly for lamps, light heads, fixtures, luminaries, and other situation requiring heat to be drawn away to protect the entity producing heat.

BACKGROUND OF THE TECHNOLOGY

A light emitting diode ("LED") produces light by as a result of passing electrical energy through particular solid components. In incandescent lamps, where electrical energy also is passed through a solid component, namely the filament, most of the electrical energy delivered to the lamp is converted to heat. A small portion is converted to light. In an LED lamp, the process is more efficient in several respects, including:

a) less electrical energy is consumed, and b) the majority of that energy is converted to light energy as opposed to heat energy.

Fluorescent lamps, including compact fluorescent lamps (hereafter the term "CFL" shall refer to both) work differently, in that instead of passing electrical energy through a solid component, the electrical energy is passed through a container holding a gas mixture typically comprising mercury and argon. First, ballast electronic circuitry converts the electrical energy from typically 120 V sinusoidal alternating current and 60 Hz, to full-wave rectification, to square-wave alternating current at much higher frequency, back to sinusoidal wave form at much higher voltage. The ballast causes the required initial "strike" electrical characteristics needed to ignite, and the post-strike characteristics that allow the CFL to operate thereafter. The resulting reaction generates heat as well ultraviolet light. The ultraviolet light, in turn excites fluorescent coating (phosphor) inside the container. That excitation produces visible light. As with the LED, the CFL lamp is more efficient than the incandescent lamp in that less electrical energy is consumed, and the majority of that energy is converted to light energy as opposed to heat energy. However, the efficiency of an LED lamp exceeds that of the CFL lamp. The CFL requires more electrical energy to produce the same amount of light as an LED lamp, and produces more heat per radiated light.

In all lamps, some of the heat produced is transferred into the lamp itself and into surrounding components. Particularly for LED and CFL lamps, this heat, although considerably less than generated by incandescent technology, can cause damage: to the LED itself or to the ballast electronics of the CFL. It is essential that this heat is transferred away quickly, sufficiently, and efficiently in order to avoid damaging the lamp.

In particular, an LED that has been exposed to high heat will likely lose efficiency, produce less light, and have a greatly reduced service life. Because of increasing efficiencies and lower costs of LED technology, and lingering problems related to mercury and the disposal of CFL lamps, LED technology will likely prevail. Thus, a need exists for high-performance heat sinks capable of removing the heat generated by LEDs.

Need for Subject Technology

What is needed is a heat sink body which comprises an extruded fixture or light head onto which the lamps are attached. Specially oriented fins and cut outs cause efficient air flow across the heat sink surface area.

SUMMARY OF THE TECHNOLOGY

The subject technology is an article of manufacture comprising a heat sink to be attached a heat source, being coupled thermally and directly for conductive flow of heat from the heat source to the heat sink. The heat sink is formed via extrusion of material of suitable density and mass to absorb heat from the particular heat source based on design requirements. The extruded heat sink is further configured with specially oriented extruded fins and machined cross cuts to increase surface area available to air flow, and arranged for efficient passage of air flow around the extruded heat sink, thus effecting efficient convection of heat from the extruded heat sink and into the air ambient. Cross cuts and fin are specifically arranged to enhance the so-called "stack effect," or "chimney effect," associated with air flow. (Wong, et al., The study of active stack effect to enhance natural ventilation using wind tunnel and computational fluid dynamics (CFD) simulations, Elsevire, Energy and Buildings, Volume 36, Issue 7, July 2004, Pages 668-678).

An objective is to maximize air flow across available surface area, and thus to enhance removal of heat into the air ambient.

DETAILED DESCRIPTION OF THE TECHNOLOGY

Figure 1:
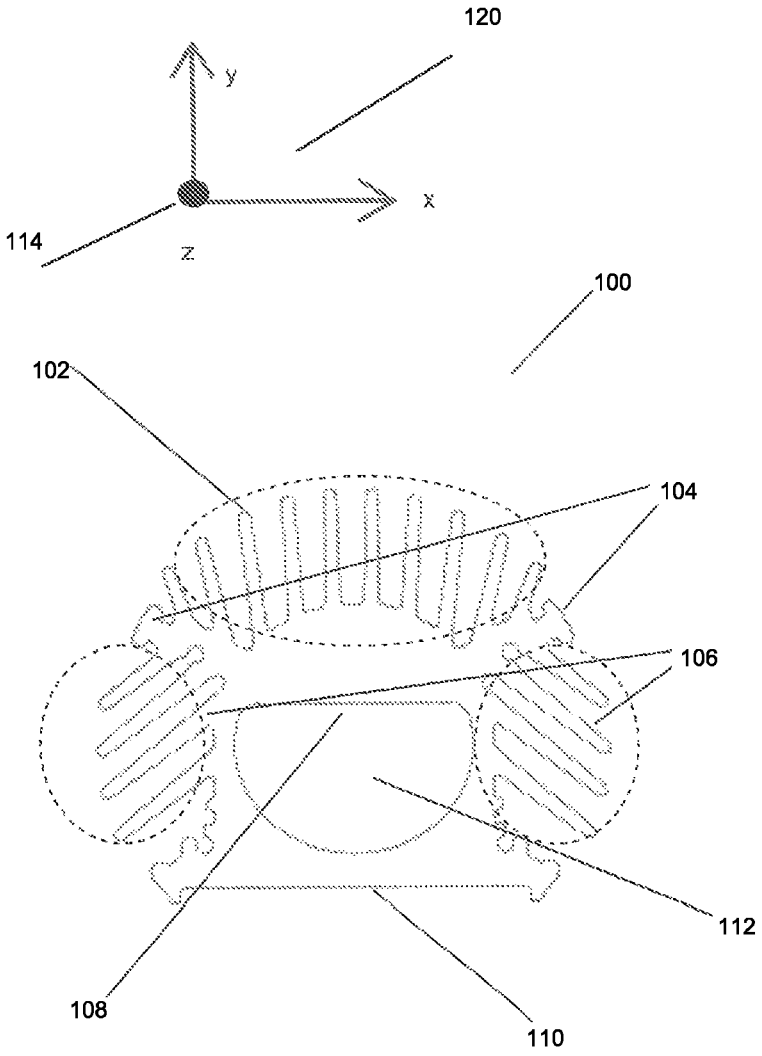
FIG. 1 shows an end profile view of the extruded heat sink.

The subject technology will be described more fully with reference to the accompanying drawings, in which a preferred embodiment of the subject technology is shown. However, persons of ordinary skill in the appropriate arts may modify the subject technology described here while still achieving the favorable results. Accordingly, the description which follows is to be understood as being a broad, teaching disclosure directed to persons of ordinary skill in the appropriate arts, and not as limiting upon the subject technology.

A heat source, which is typically one or more LED lamps, is thermally and directly coupled to the extruded heat sink inside an interior cavity, so that light is radiated outward through an aperture. The heat source is thermally coupled in series via one or more intermediate thermally conductive materials, which are in series adjacent with the heat source and which are themselves thermally coupled to each other. The thermally conductive materials, although they serve particular purposes, also allow the conductive flow of heat from the LED to the extruded heat sink. The thermally conductive materials include printed circuit boards ("PCB") onto which the LED is electrically and mechanically coupled, and a thermally conductive pad or paste, bonding the adjacent intermediate thermally coupled material to the extruded heat sink.

Certain definitions are stated to assist in interpreting this description and the Figures.

A "lamp" is an actual light source, such as an LED, compact fluorescent light ("CFL") bulb, fluorescent tube, or incandescent bulb.

A "light head" receives the lamp, and is generally portable.

A "fixture" receives the lamp, and is generally fixed.

A "luminaire" is a complete assembly providing illumination. The term used especially in technical contexts. A luminaire may be a fixture or light head. In this case, the luminaire is sealed to prevent intrusion of water, gasses, and dirt.

For two entities to be "coupled thermally directly for conductive flow of heat" from one entity to the other means that there is no intermediate entity between the entities that substantially impedes the flow of heat from one entity to the other. Indeed, any intermediate entity is designed or otherwise selected to promote conduction of heat.

"Direction of extrusion" refers to the longitudinal direction of extruded material out of an extrusion die. As will be discussed further, pathways for additional air flow created by cross cuts are generally perpendicular to the direction of extrusion. Complementary to the direction of extrusion is a perpendicular in all planes. For example, if the direction of extrusion is along the z axis in conventional terms, then x and y axes in all planes are perpendicular to the direction of extrusion.

The terms "extrusion" and "heat sink" may be used interchangeably. The product of extrusion here is a single body that and operates as a heat sink after application of cross cuts.

The extruded heat sink comprises generally a cylindrical tube with a machined cut opening along an outside surface, exposing an interior cavity and creating an aperture. Additionally, a grooved feature is machined cut around the aperture opening, creating a pocket for a gasket or adhesive seal. This gasket seal forms a flexible water tight barrier between a transparent glass or polymer window and the extrusion. The extruded heat sink, as a property of extrusion process, is open at two ends. Furthermore, the extruded heat sink provides a platform inside an interior cavity and on an interior side onto which the heat source is thermally and directly coupled. The process of extrusion naturally leaves ends open, revealing the interior cavity.

FIG. 1 shows an end profile view of the extruded heat sink 100. For reference purposes, FIG. 1 also shows a 3-dimensional coordinate system 120, with x, y, and z axes. The z-axis represents an axis of extrusion 114, indicating the direction in which extruded material leaves an extrusion die. As shown, points along the y-axis are positive upward on the page and points along the x-axis are positive to the right of the page.

The extruded heat sink 100 is generally tubular, with a cavity 112, a set of back fins 102, sets of side fins 106, and a front surface 110, all of which being formed as a result of extrusion. The cavity 112 defines a mounting surface 108. The back fins 102 generally run parallel to the axis of extrusion 114 and generally extend away orthogonally from the axis of extrusion 114. The side fins 106 generally run parallel to the axis of extrusion 114 and generally extend away obliquely from the axis of extrusion 114 and relative to a perpendicular to the axis of extrusion 114, angled towards the front surface 110. FIG. 1 also shows "T-shaped" adapter fins, as stud ridges, for use in attaching two or more extruded heat sinks 100 together or for attaching various other parts to the extruded heat sink 100.

Extruded material is any material suitable for extrusion and with sufficient thermal conductivity, and most particularly aluminum or aluminum alloys. Although other forms of manufacture are available for producing a desired shape, including forging and casting, extrusion produces superior results for the contemplated embodiments. The superior results include creation on the cavity 112 into which lamps will be deployed, lower costs, and greater thermal conductivity. (Jackson, Steve; Aluminum extrusions match SSL thermal management need in many applications; LEDs Magazine, April 2013). Furthermore, extrusion makes the resulting product very dense and thus very massive, which allows it to absorb more heat away for the heat source.

Figure 2:
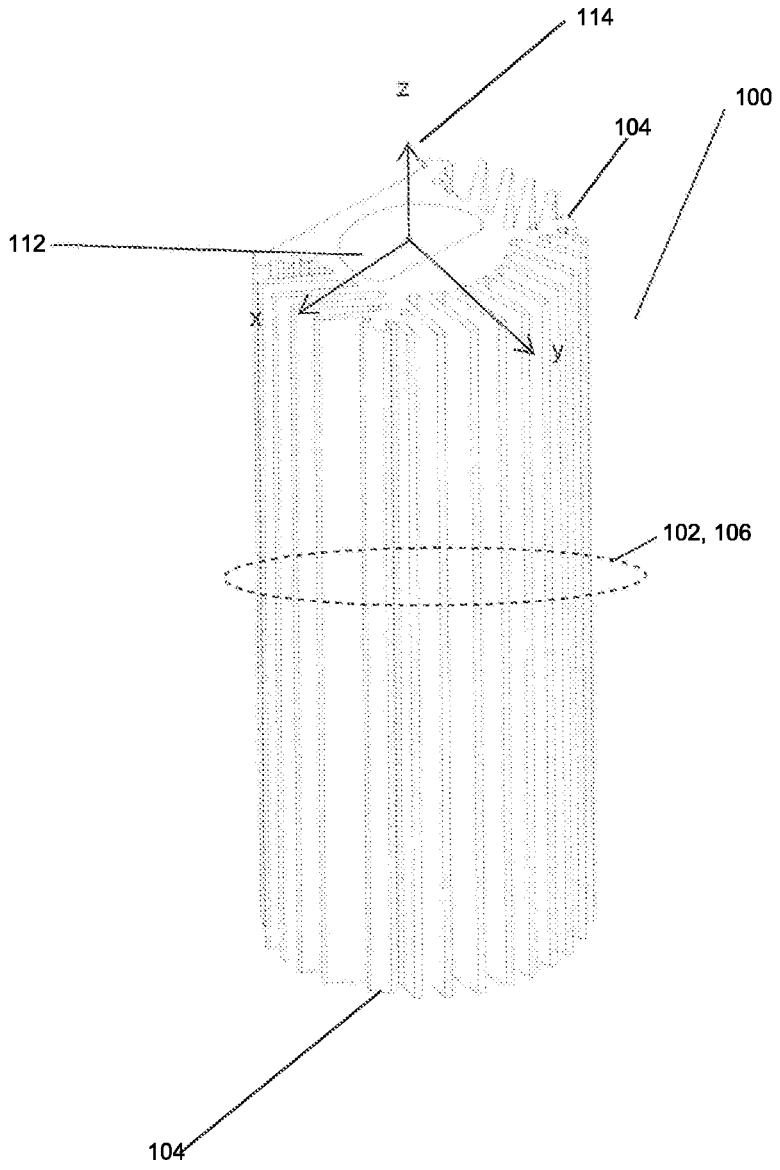
FIG. 2 is a view of the back of the extruded heat sink, before cross cuts are applied.

FIG. 2 is a view of the back of the extruded heat sink 100, before further modification. The axis of extrusion 114 is upward. Back fins and side fins 106 are shown relative to the axis of extrusion 114 and the cavity 112.

Figure 3:
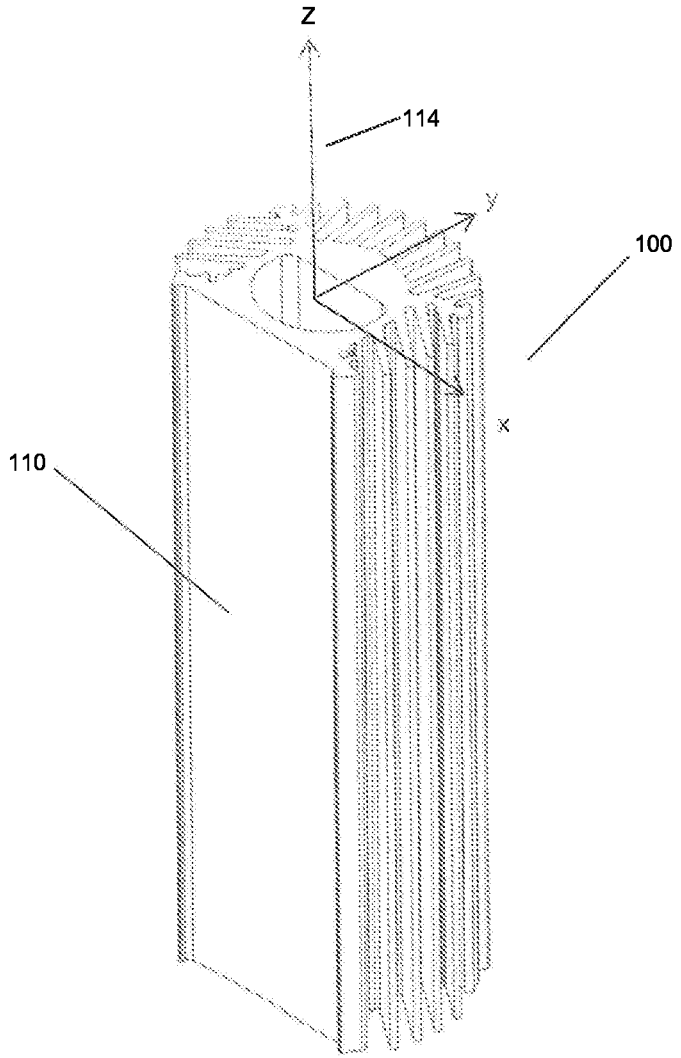
FIG. 3 is a view of the front of the extruded heat sink, before cross cuts are applied.

FIG. 3 is a view of the front of the extruded heat sink 100, before further modification. The front surface 110, shown relative to the axis of extrusion 114 and the cavity 112, is uncut in this view.

Figure 4:
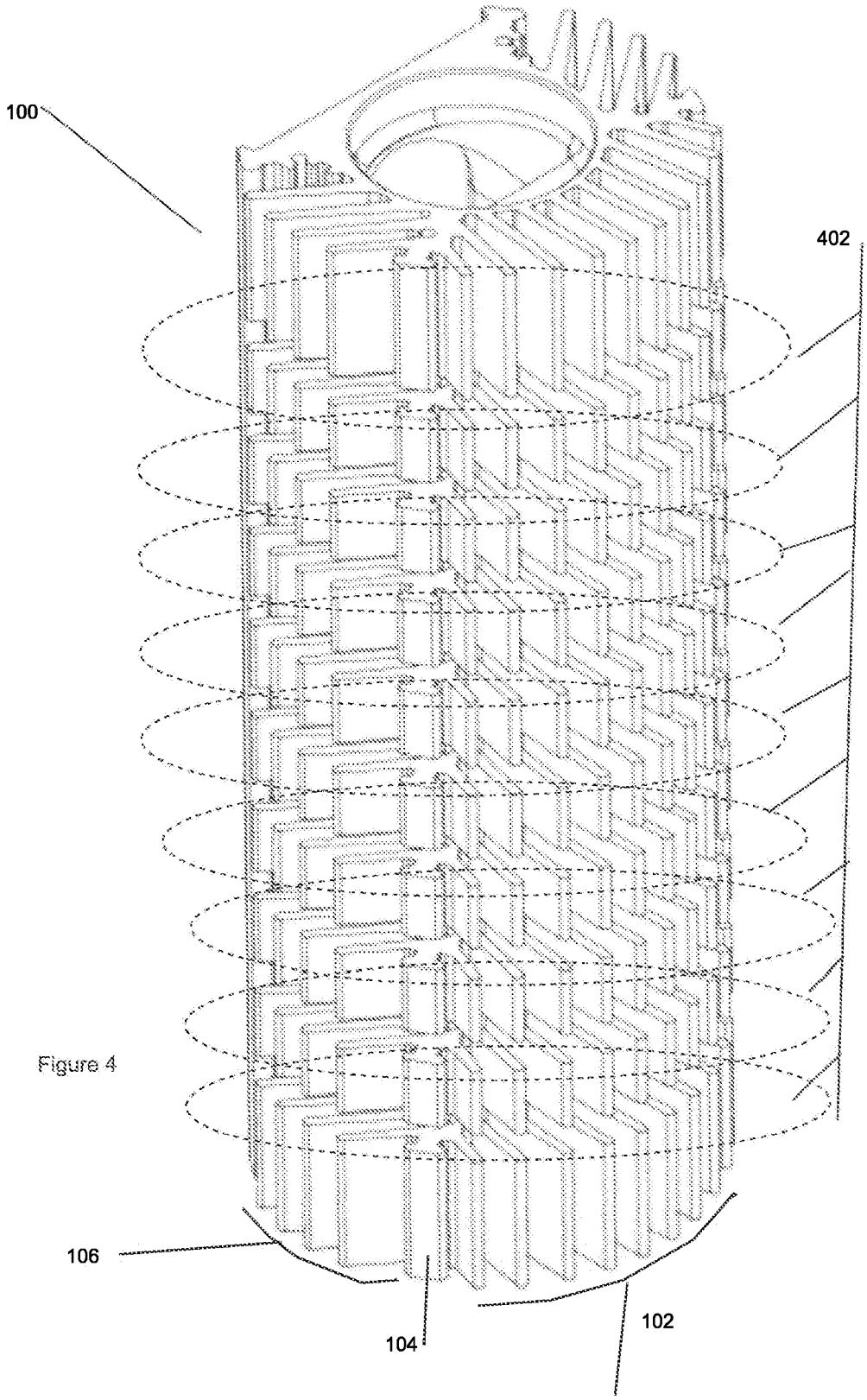
FIG. 4 is a view of the back of the extruded heat sink, with cross cuts applied.
Figure 5:
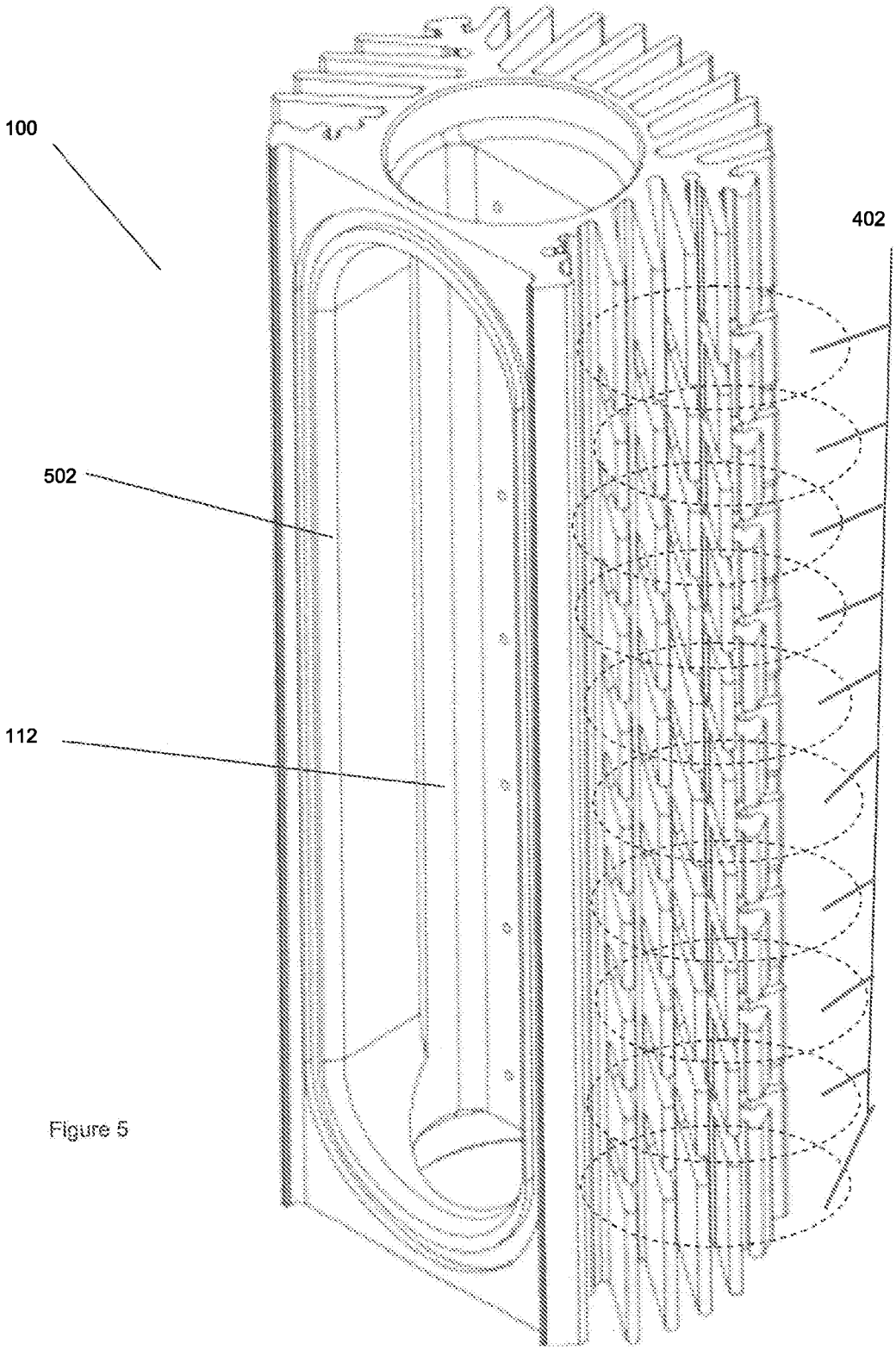
FIG. 5 is a view of the front of the extruded heat sink, with cross cuts applied.

FIG. 4 is a view of the extruded heat sink 100, modified with cross cuts 402 applied to the back fins 102, side fins 106, and adaptor fins 104. Similarly, FIG. 5 is a front and side view of the extruded heat sink 100, with cross cuts 402 applied. FIG. 5 also shows an aperture 502 cut into the front surface 110, revealing the cavity 112 inside. When the extruded heat sink 100 is fully assembled, source of light 720 would be deployed within the cavity 112, on the mounting surface 108, with the light 720 directed outward through the aperture 502. In both FIGS. 4 and 5, the cross cuts 402 are arranged generally orthogonally to the direction of extrusion.

Figure 6:
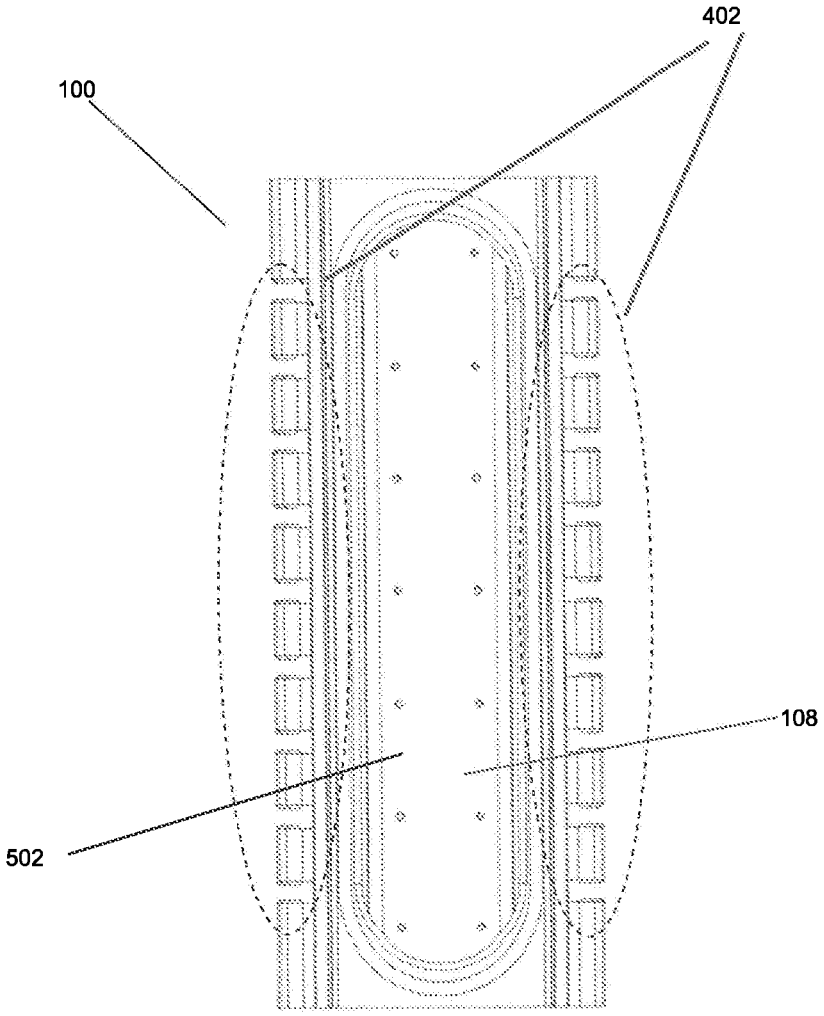
FIG. 6 is a front view of the extruded heat sink, with cross cuts applied, and also showing an aperture cut revealing an internal extrusion cavity.

FIG. 6 is a front view of the extruded heat sink 100, with cross cuts 402 applied, and showing the cavity 112 and mounting surface 108 as seen through the aperture 502. The mounting surface 108 further comprises a heat conduction surface for heat and light producing components mounted on it.

Figure 7:
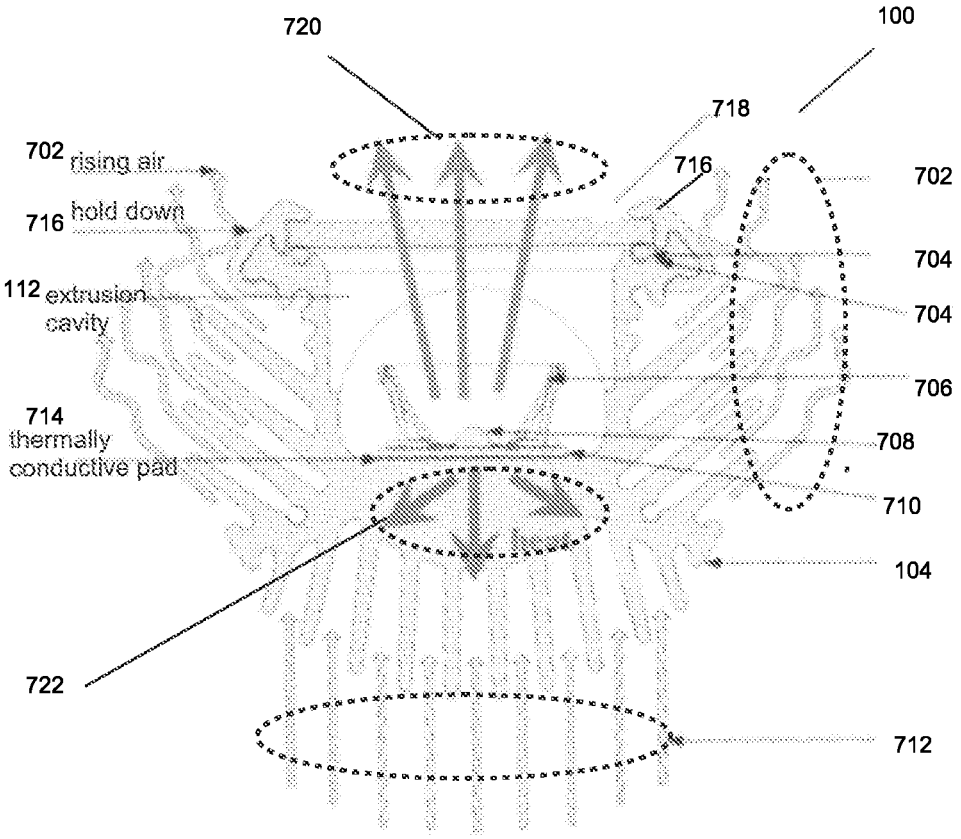
FIG. 7 is an end profile view showing air flow around the extruded heart sink, oriented with the light directed upward.

FIG. 7 is an end profile view showing air flow around the extruded heat sink 100, oriented with the light 720 directed upward with respect to gravity. Electrical energy delivered to an LED 708 lamp is primarily converted to light 720 and heat 722. The light 720 here is in the visible and non-visible light 720 spectrum, radiated outward; and heat 722 retained in and around the LED 708, but which must be conducted away in order to avoid damage to the LED 708 lamp. A fundamental principle of passive heat sink operation is drawing heat away from an entity, generally by conduction through one or more intermediate thermally conductive, and thermally coupled materials, to the thermally coupled heat sink. The heat sink, being warmed by the heat transferred to it, allows convection via air currents to transfer heat from the heat sink, to the air ambient. It is well-known that warm air is less dense than cooler air, and thus warm air rises opposite of the direction of gravity when it is surrounded by cooler air. As less-dense warm air is drawn away, cooler, denser air takes its place. Thus, the cooler, denser air is in place to receive additional heat from the heat sink. This operation is further shown in FIG. 7, where heat 722 from an LED 708 lamp is conducted through a printed circuit board PCB 710 on which the LED 708 is mounted, through a thermally conductive pad 714, and to the extruded heat sink 100. The heat 722 propagates through the extruded heat sink 100, and arrives at the back fins 102 and side fins 106. Air around the back fins 102 and side fins 106 carry heat 722 away in rising air 702, and cooler incoming air 712 arrives to replace the rising air 702.

FIG. 7 also shows a lens 718 covering the aperture 502 and the cavity 112, through which light 720 passes. The lens 718 comprises transparent material which may or may not otherwise modify the light 720. An o-ring 704 provides a seal between the lens 718 and the body 906 of the heat sink, as protection against moisture and gasses.

FIG. 7 also reveals hold down 716 clips configured to hold the lens 718 in place, being attached to adaptor fins 104. Associated with the LED 708 lamp is a reflector 706 for directing the light 720 outward, through the lens 718.

Figure 8:
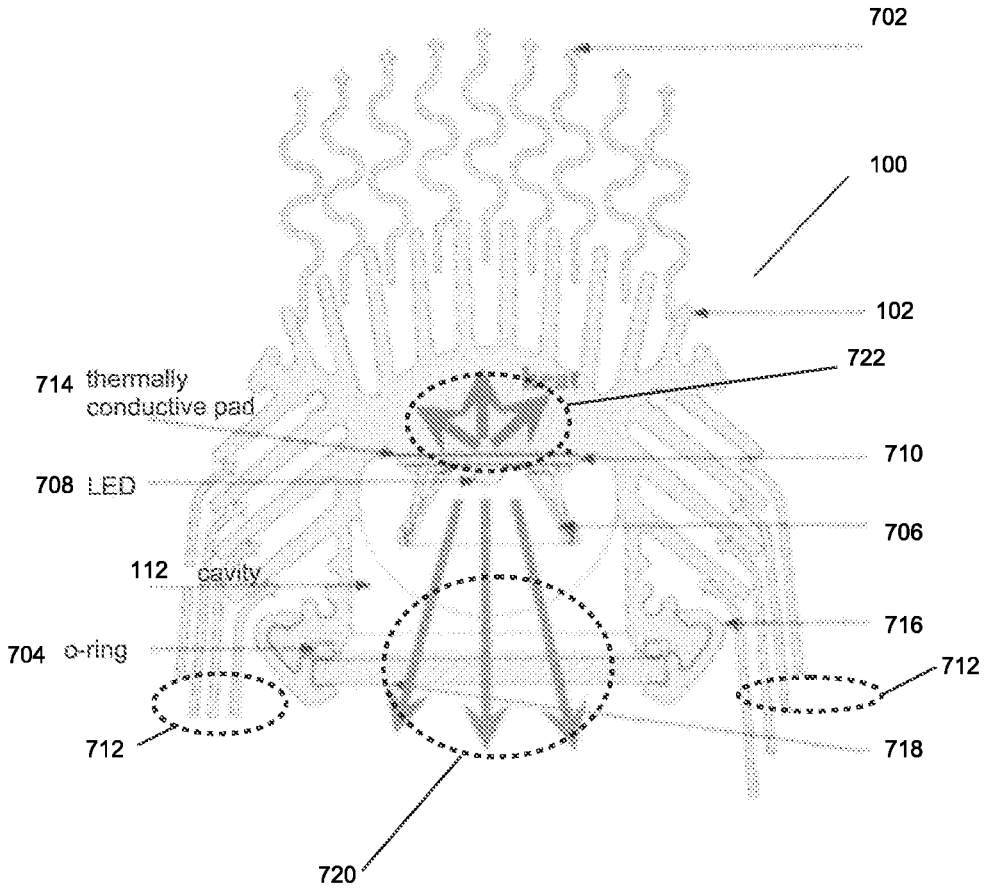
FIG. 8 is an end profile view showing air flow around the extruded heart sink, oriented with the light directed downward.

FIG. 8 is an end profile view showing air flow around the extruded heat sink 100, oriented with the light 720 directed downward with respect to gravity. The flow of heat 722 is similar to that described with respect to FIG. 7, however initial directions of heat 722 and light 720 from the LED 708 lamp are opposite.

Figure 9A:
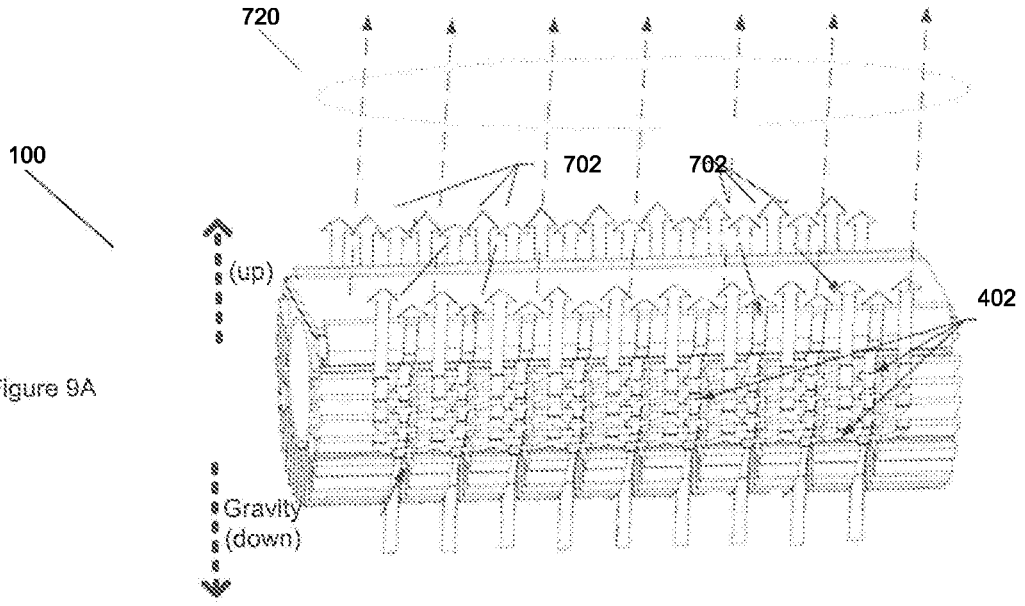
FIGS. 9A and B are views showing air flow around the extruded heart sink, oriented with the light directed upward and downward, respectively.
Figure 9B:
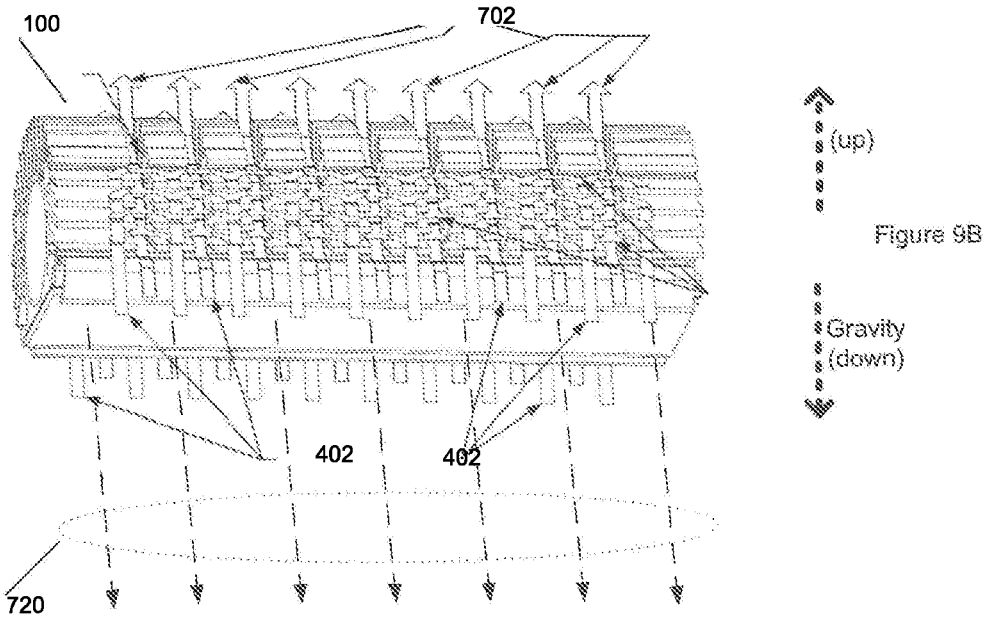
Figure 10:
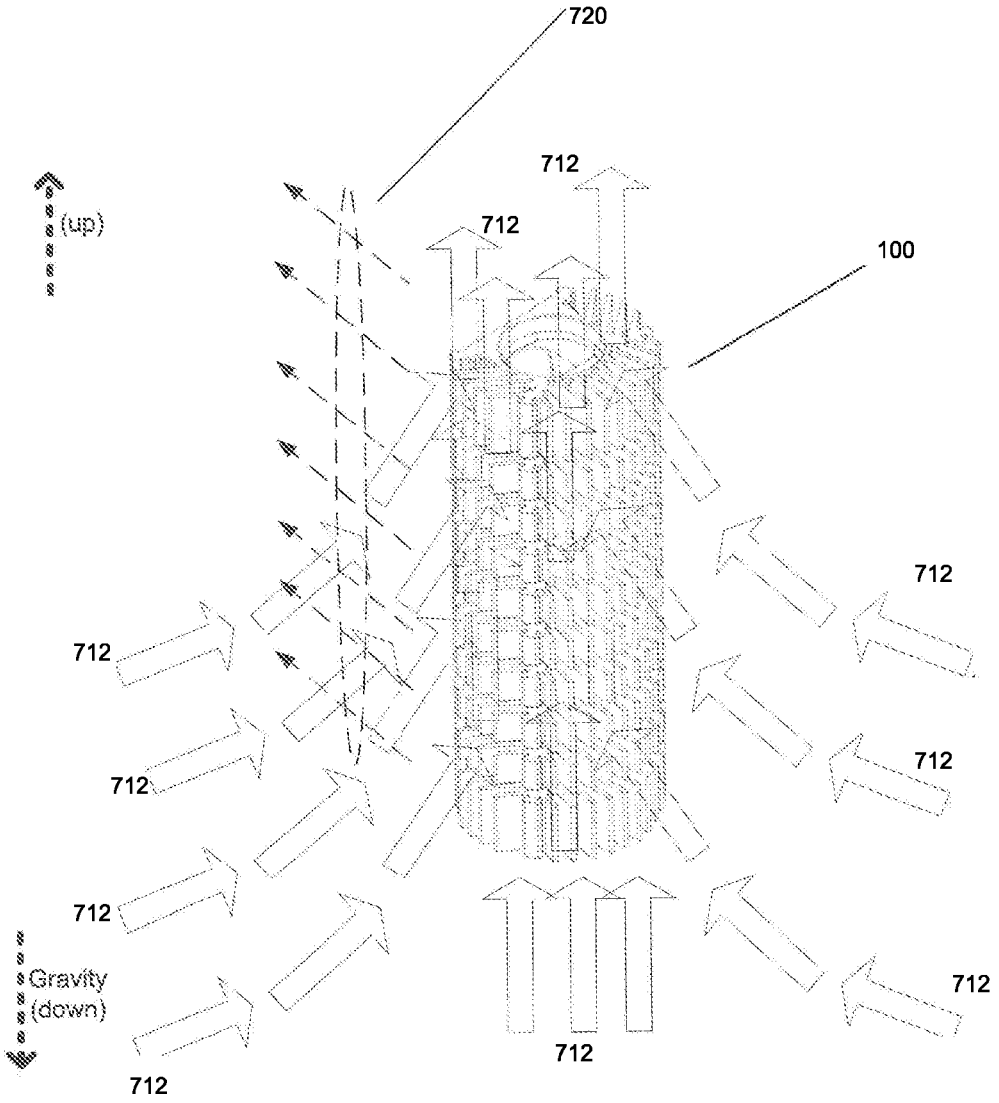
FIG. 10 is a view showing air flow around the extruded heart sink, oriented with the light directed orthogonally with respect to gravity.

FIGS. 9A, 9B, and 10 show how cross cuts 402 enhance the flow of air around the extruded heat sink 100, and thus enhance the extruded heat sink 100 capacity to transfer heat 722 into the air ambient.

FIGS. 9A and 9B are views showing air flow around the extruded heat sink 100, oriented with the light 720 directed upward and downward, respectively, with respect to gravity. In both FIGS. 9A and 9B, the flow of cool incoming air 712 onto the extruded heat sink 100, drawn in by the flow of warm rising air 702, is channeled by the cooperation and arrangement among back fins 102, side fins 106, and cross cuts 402. The channeling moves the cool incoming air 712 across and around the surface area of the back fins 102 and side fins 106, and along the length of the extruded heat sink 100. An objective is to achieve efficient exposure of incoming air 712 to available heated surface area so that the heat may be transferred into the air ambient.

FIG. 10 is a view showing air flow around the extruded heat sink 100, oriented with the light 720 directed orthogonally with respect to gravity. The same operation applies as depicted in FIGS. 9A and 9B, although the primary effect is the channeling of cooler incoming air 712 along the length of the body of the extruded heat sink 100, with additional cooler air being drawn in and through the cross cuts 402.

Light directed upward, causing heat initially to be driven downward as in FIG. 7, is the most difficult situation. This requires the heat sink to draw heat downward, against nature. Even at that, the extruded heat sink 100 performs well.

Figure 11:
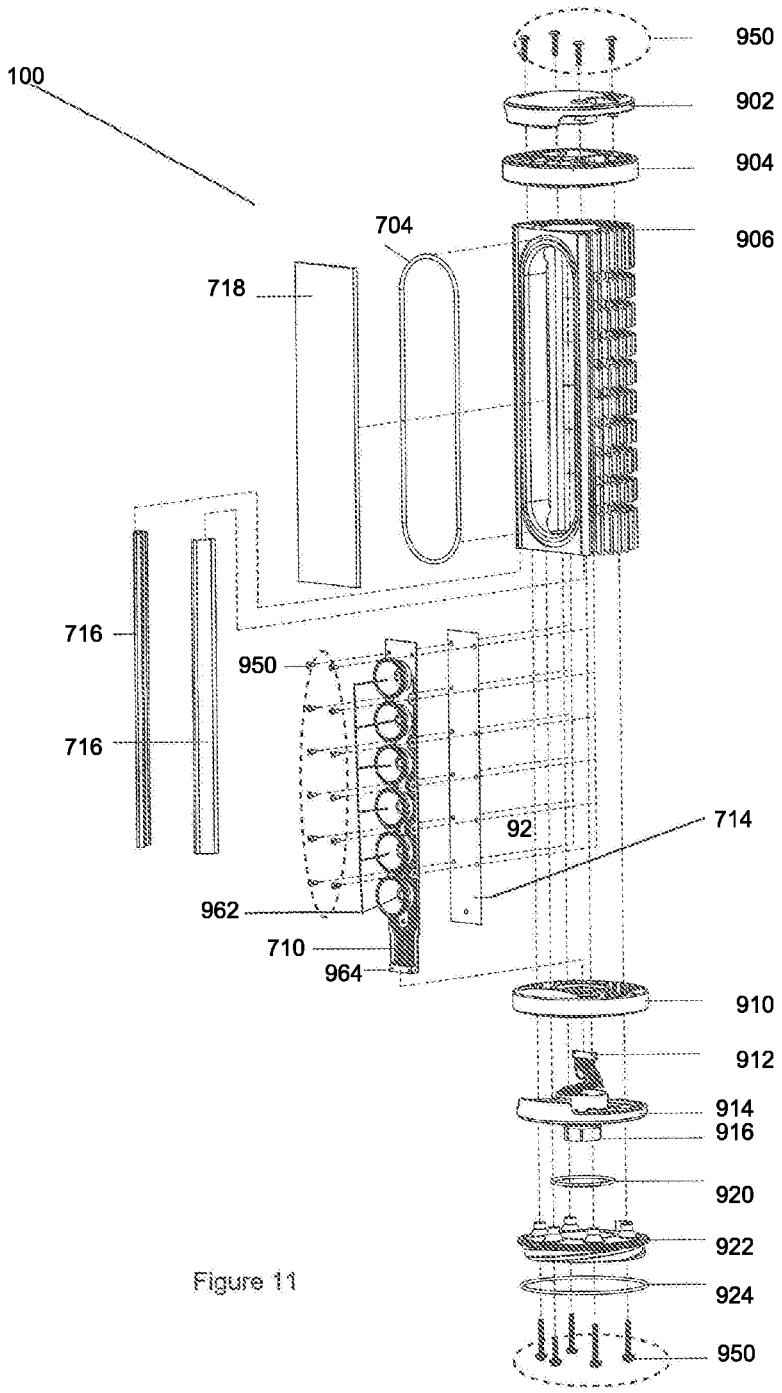
FIG. 11 is an exploded view of the preferred embodiment.

FIG. 11 is an exploded view of a preferred embodiment of the extruded heat sink 100. The extruded heat sink 100 is shown with cross cuts 402, and various additional components and features which, taken together, result in a luminaire. A top cap 902, followed by a top seal 904, closes one end of the extruded heat sink 100. Screws hold the top cap 902 and top seal 904 to the extruded heat sink 100.

An assembly comprises an LED 708 reflector assembly 962 comprising one or more reflector 706*s*, further containing individual LED 708 lamps deployed within the reflector 706*s*. The reflector 706*s* are configured to collect light 720 from the LED 708 lamps, and to direct the light 720 outward. The LED 708 reflector assembly 962 further comprises a PCB 710, generally of aluminum and having a front side and a back side, and an internal electrical connector 964 attached to the PCB 710. The LED 708 reflector assembly 962 is connected to the front side of the PCB 710. The PCB 710 and internal electrical connector 964 are configured so that electrical energy delivered to the internal electrical connector 964 is delivered to the LED 708 lamps. The assembly further comprises a thermally conductive pad 714 connected to the back side of the PCB 710. The assembly is attached, via screws 950, to the mounting surface 108 (not shown in FIG. 11) within the extrusion cavity 112, with the thermally conductive pad 714 being physically adjacent to the mounting surface 108. The thermally conductive pad 714 delivers heat generated by the LED 708 lamps to extruded heat sink 100.

The o-ring 704 is deployed at the aperture 502, between the lens 718 and the extruded heat sink 100, the o-ring 704 thus providing a seal. Light from the LED 708 lamps passes through the lens 718. A hold downs 716 secure the lens 718 to the extruded heat sink 100.

A bottom assembly completes the closure and sealing of the extruded heat sink 100, and provides means for delivering electrical energy to the internal electrical connector 964. In the order of connection, the bottom assembly comprises: a bottom seal 910; a bottom cap 914, further comprising internal electrical connector 912 which passes through the bottom seal 910, and an external electrical connector 916; an o-ring 920 providing a seal for the external electrical connector 916; a thread connector attachment plate 922, through which the external electrical connecter 916 passes to receive electrical energy; an o-ring 924 for sealing the thread connector and bottom assembly and an external power source (not shown); and screws 950 holding the bottom assembly to the extruded heat sink 100. The external power source comprises a battery or other source that connects to the external electrical connector 916 which protrudes from the thread connector attachment plate 922.

Finite Element Analysis

Finite element analysis shows heat transfer characteristics of the extruded heat sink 100 in several conventional orientations. These orientations include light directed downward, light directed upward, light directed horizontally, and several variations. Finite element analysis was conducted with these initial parameters:

air ambient being 33 degrees Celsius

3 LED heat sources each producing 24.3 Watts (for a total of 72.9 Watts)

0.1 Degree Celsius/Watt thermal resistance of the thermally conductive pad on the mounting surface Results of the analysis, in the light upward configuration of FIG. 7, were as follows:

maximum air velocity was approximately 0.252 m/s maximum temperature at the heat source (LED) was approximately 74 degrees Celsius temperature of the extruded heat sink 100 at the interface with the air ambient 62 degrees Celsius computed case to ambient thermal resistance 0.563 degrees Celsius/Watt

Advantages of the Subject Technology

The subject technology delivers several advantages, including:

Works well in any orientation relative to gravity and rising air

Light weight

Totally passive cooling design; no added mechanical systems required for cooling Extrusion is superior to die casting: less expensive and can have variable lengths for manufacturing. Although the extruded aluminum structure is relatively expensive, it is less so than a die cast product.

Simple manufacturing: The heat sink is extruded, and then the cross cuts and opening aperture are cut out.

The "T-shaped" adapter fins allow for linear length-wise combination and connectivity of several heat sinks or to other mechanical attachment mounts. Extruded heat sink 100*s* may be aligned along the extrusion axis, and connected via clamps at the "T-shaped" adapter fins.

Few water leak points, relative to the aperture. An "O" ring around a glass covering (covering the aperture) provides a seal. Other O-rings provide seals where electrical connectors are introduced and at ends.

Other control or power electronics, which are outside of the heat sink interior, still benefit from the heat sink if thermally coupled to the heat sink body. The structure is physically strong and can be used as load bearing physical support elements.

The extruded heat sink 100 is never hot to the touch when in use.

Best Mode of the Preferred Embodiment

A preferred embodiment of the subject technology is as a light head, fixture, or luminaire, as show in in FIG. 11. The subject technology could be used for other heat sources, instead of LED lamps.

While the foregoing written description enables one of ordinary skill to make and use what is considered presently to be the best mode thereof, those of ordinary skill will understand and appreciate the existence of variations, combinations, and equivalents of the specific embodiment, method, and examples herein. For example, the arrangement of the second set of fins, may be angled differently or not angled at all. Unless claimed, particular system architecture and algorithms shown are not critical, but represent one or more embodiments.

We claim:

1. A heat sink comprising, an extruded body, said extruded body having an axis defining a direction of extrusion;

said extruded body further having an interior surface and an exterior surface;

fins on the exterior surface, said fins being aligned parallel to said axis;

an interior cavity formed within said extruded body and defining said interior surface;

a mounting surface on said interior surface;

end apertures in planes perpendicular to said axis, formed from extrusion and revealing said interior cavity;

an aperture cut into said exterior surface, revealing said mounting surface, said aperture being opposite to said mounting surface;

a first subset of said fins comprising side fins at oblique angles relative to a perpendicular to said axis;

a second subset of said fins comprising back fins being at right angles relative to the perpendicular to said axis;

and said fins having a plurality of cross cuts.

2. A luminaire comprising a heat sink, further comprising an extruded body, said extruded body having an axis defining a direction of extrusion;

said extruded body further having an interior surface and an exterior surface;

fins on the exterior surface, said fins being aligned parallel to said axis;

an interior cavity formed within said extruded body and defining said interior surface;

a mounting surface on said interior surface; end apertures in planes perpendicular to said axis, formed from extrusion and revealing said interior cavity;

an aperture cut into said exterior surface, revealing said mounting surface, said aperture being opposite to said mounting surface;

a first subset of said fins comprising side fins at oblique angles relative to a perpendicular to said axis;

a second subset of said fins comprising back fins being at right angles relative to the perpendicular to said axis;

and said fins having a plurality of cross cuts;

a lamp mounted onto said mounting surface, wherein light from said lamp is directed through the aperture;

a lens covering said aperture; a top cap covering one of said end apertures;

a bottom cap covering the other of said end apertures; seals deployed with said lens, said top cap, and said bottom cap, to prevent intrusion of water, gases, and dirt.

3. A method for manufacturing a heat sink comprising extruding a body, thereby forming fins, an interior cavity, an exterior surface, an interior surface, a mounting surface, and end apertures;

creating cross cuts in said fins;

and cutting an aperture into said exterior surface, thereby revealing said mounting surface.

* * * * *